US005836780A

United States Patent [19]

Mizumura et al.

[11] Patent Number: 5,836,780

[45] Date of Patent: Nov. 17, 1998

[54] CARD EDGE CONNECTOR

[75] Inventors: Akinori Mizumura; Ryozo Koyama; Hirokatsu Yaegashi, all of Tokyo, Japan

[73] Assignee: Hirose Electric Co., Ltd., Tokyo, Japan

[21] Appl. No.: 858,812

[22] Filed: May 19, 1997

[30] Foreign Application Priority Data

May 17, 1997 [JP] Japan ..... 8-123136

[51] Int. Cl.[6] ..... H01R 13/62

[52] U.S. Cl. ..... 439/326

[58] Field of Search ..... 439/59–62, 326–329, 439/629–637

[56] References Cited

U.S. PATENT DOCUMENTS

| | | | |
|---|---|---|---|
| 5,567,171 | 10/1996 | Mizuguchi | 439/630 X |
| 5,641,295 | 6/1997 | Koyama | 439/326 |
| 5,695,354 | 12/1997 | Noda | 439/326 |

FOREIGN PATENT DOCUMENTS 6-31088 4/1994 Japan .

6-77178 10/1994 Japan .

*Primary Examiner*—Khiem Nguyen
*Attorney, Agent, or Firm*—Kanesaka & Takeuchi

[57] ABSTRACT

A card edge connector to be surface-mounted on a circuit board having a plurality of conductors, which includes an insulation housing (100) having a base section (111) with a slot (112) for receiving a card edge on which a plurality of contact pads are provided; a plurality of bent-type contact elements arranged in the slot on at least one side (114) on which the connector is to be mounted on the circuit board; a plurality of movable arms (301) having contact points (307) for contact with the contact pads of the card; a plurality of fixing arms (303) having connection sections for connection to the conductors of the circuit boards and fixing sections (500) to be fixed to the insulation housing; a plurality of central arms (302) for connecting the movable arms and the fixing arms to form the substantially C-shaped, flexible contact elements; the connection sections of the fixing arms being at positions opposite to the central arms with respect to the fixing sections (500); and the contact points of the movable arms being at positions above the fixing sections or opposite to the central arms with respect to the fixing sections.

13 Claims, 10 Drawing Sheets

CARD EDGE CONNECTOR

BACKGROUND OF THE INVENTION

1. Field of the Invention

The present invention relates to card edge connectors to which memory or IC cards are connected by rotation in parallel to boards and, more particularly, to contact elements for use in such card edge connectors.

2. Description of the Prior Art

Japanese UM patent application Nos. 31088/94 and 77178/94 disclose such card edge connectors. The contact elements used in such card edge connectors are the so-called "punched-out terminals" which are made by punching resilient conductive metal sheets. In contrast to the punched-out terminals, there are the so-called "bent terminals" which are made by stamping conductive metal sheets and bending them to provide resilient properties.

Japanese '088 discloses substantially C-shaped punched-out terminals having contact arms and attaching legs. The attaching legs of contact elements are press fitted in insulation housings having complementary shapes with respect to the contact elements. The contact arms of the contact elements define a card insertion opening in which a card is inserted to be connected to the contact elements. The tine sections of contact elements are soldered onto the surface of a circuit board (surface mount). There are two types of contact elements. First contact elements have contact arms for contact with the upper surface of a card inserted. Second contact elements have contact arms for contact with the lower surface of a card. These two types of contact elements are substantially identical except for the contact arms. When a card is inserted into the card insertion section and rotated toward the circuit board, an upward force is applied to the attaching legs of first contact elements while a downward force is applied to the attaching legs of the second contact elements owing to a moment of rotation. It is believed that these forces are opposite in direction and offset each other. Also, it is believed that these forces are distributed to the entire attaching legs so that the stress is not locally concentrated in the housing.

However, the attaching legs cannot absorb all of the moment of rotation generated by the rotation of a card so that a considerable amount of stress remains in the tine sections. Consequently, it is still possible that a crack takes place between the tine sections and the circuit board. Also, the contact elements are so short that it is impossible to distribute the stress efficiently, and a considerable amount of stress is applied to the attaching legs. Consequently, the housing can be broken or cracked. The so-called "punched-out terminals" used here much have a very large spring constant in order to hold a card securely. For this reason, the spring constant is set at a sufficiently large value to provide a satisfactory contact force for a card having a minimum allowable thickness. In such a design, however, when a card of a maximum allowable thickness is inserted, terminals can be deformed.

The contact element of Japanese '178 is a "bent terminal." This terminal does not have any attaching leg. Consequently, this terminal has no means to distribute the moment of rotation generated in the contact arm. However, there is no problem with the upper side contact elements because a downward force is applied to the tine sections on the circuit board. However, an upward force is applied to the lower side contact elements to pull up the tine sections from the circuit board.

SUMMARY OF THE INVENTION

Accordingly, it is an object of the invention to provide a contact element having a high resilient property with a small spring constant.

It is another object of the invention to provide a contact element having a large length in a small space.

It is still another object of the invention to provide a contact element resistant against separation from the circuit board.

According to the invention there is provided a card edge connector to be surface-mounted on a circuit board having a plurality of conductors, which includes an insulation housing having a base section with a slot for receiving a card edge on which a plurality of contact pads are provided; a plurality of bent-type contact elements arranged in the slot on at least one side on which the connector is to be mounted on the circuit board; a plurality of movable arms having contact points for contact with the contact pads of the card; a plurality of fixing arms having connection sections for connection to the conductors of the circuit boards and fixing sections to be fixed to the insulation housing; a plurality of central arms for connecting the movable arms and the fixing arms to form the substantially C-shaped, flexible contact elements; the connection sections of the fixing arms being at positions opposite to the central arms with respect to the fixing sections; and the contact points of the movable arms being at positions above the fixing sections or opposite to the central arms with respect to the fixing sections.

The bent terminals are fixed to the insulation housing by press-fitting the wide sections of the fixing arms into the insulation housing. The barbs are provided on the wide sections to assure the fixation.

The stoppers provided on the tips of the bent terminals engage notches or projections of the insulation housing to bias the movable arms toward the circuit board forming a preload condition.

Every other bent terminals are offset in the card insertion direction forming two rows of the bent terminals.

According to another aspect of the invention there is provided a card edge connector to be surface-mounted on a circuit board having a plurality of conductors, which includes an insulation housing having a base section with a slot for receiving a card edge on which a plurality of contact pads are provided; a plurality of first bent-type contact elements arranged in the slot on a first side opposite to a second side on which the connector is to be mounted on the circuit board; a plurality of second bent-type contact elements arranged in the slot on the second side; a plurality of movable arms having contact points for contact with the contact pads of the card; a plurality of fixing arms having connection sections for connection to the conductors of the circuit boards and fixing sections to be fixed to the insulation housing; a plurality of central arms for connecting the movable arms and the fixing arms to form the substantially C-shaped, flexible contact elements; the connection sections of the fixing arms being at positions opposite to the central arms with respect to the fixing sections; and the contact points of the movable arms being at positions above the fixing sections or opposite to the central arms with respect to the fixing sections.

The first and second bent terminals are fixed to the insulation housing by press-fitting the wide sections of the fixing arms into the insulation housing. The barbs provided on the wide sections assure the fixation.

The stopper provided on the tips of the movable arms of the second bent terminals engage notches or projections to bias the movable arms toward the circuit board forming a preload condition.

Every other second bent terminals are offset in the insertion direction forming two rows of the second bent terminals.

The bent terminals are joined together with a linking section provided at the fixing arms to facilitate insertion of a large number of bent terminals into the insulation housing.

DESCRIPTION OF THE PREFERRED EMBODIMENT

Figure 1:
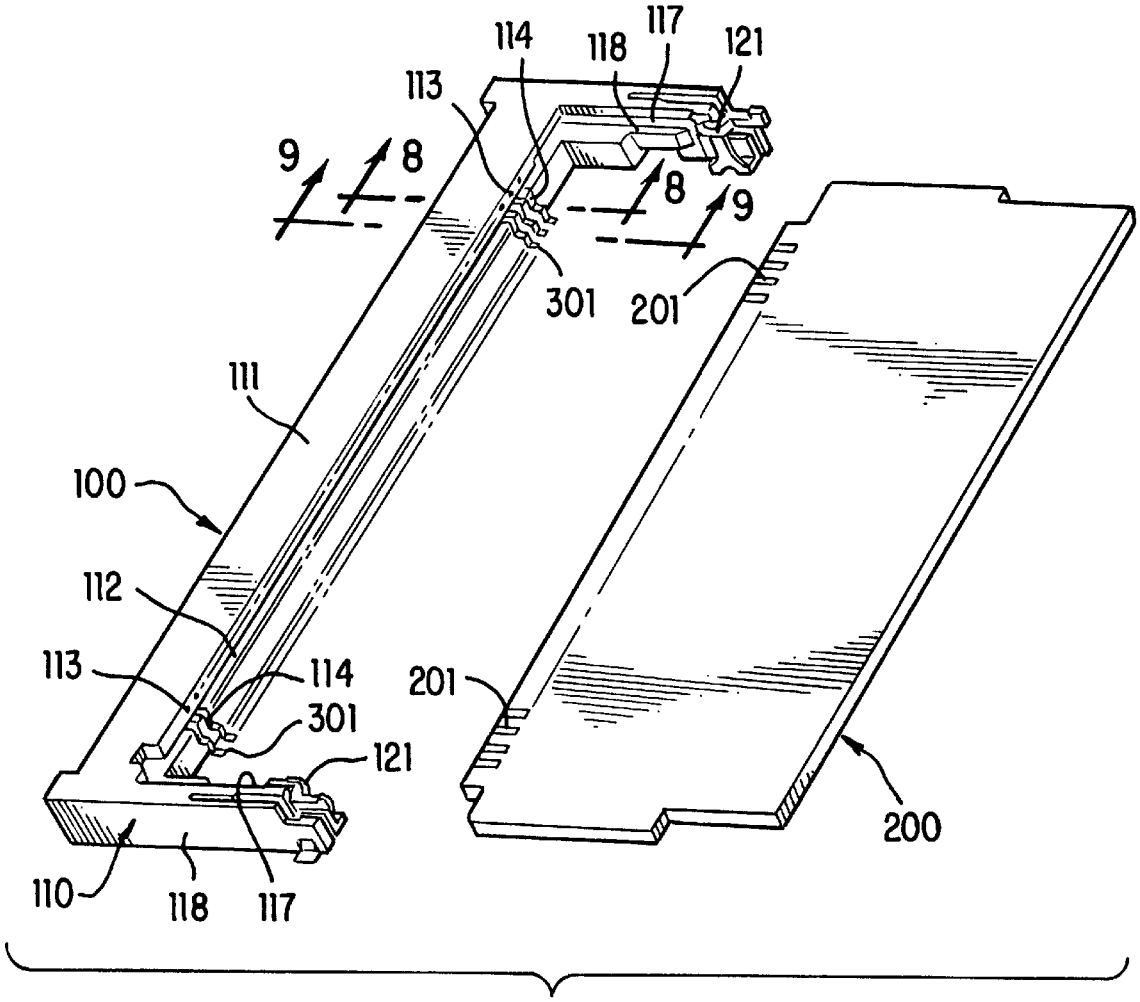
FIG. 1 is a perspective view of an edge card connector according to an embodiment of the invention before a card is inserted.
Figure 2:
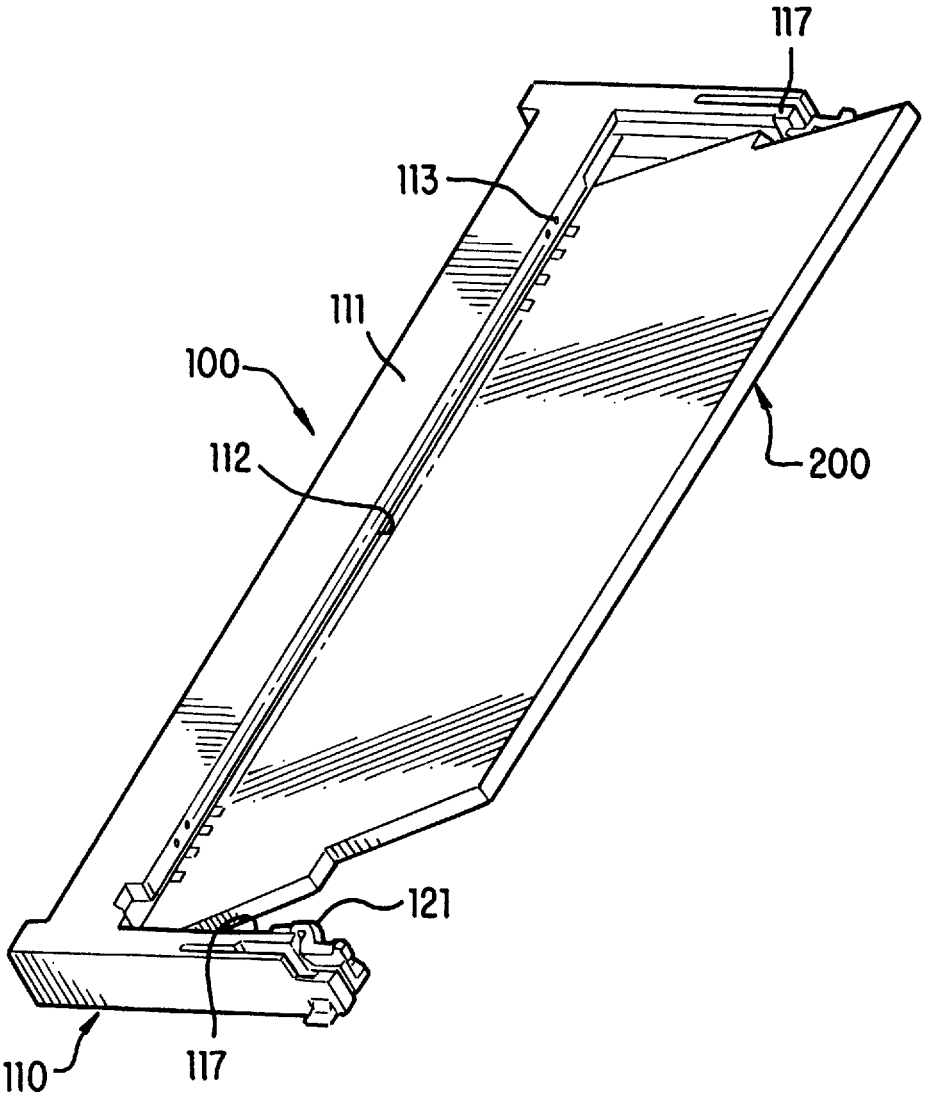
FIG. 2 is a perspective view of the edge card connector into which a card is inserted but not fixed yet.
Figure 3:
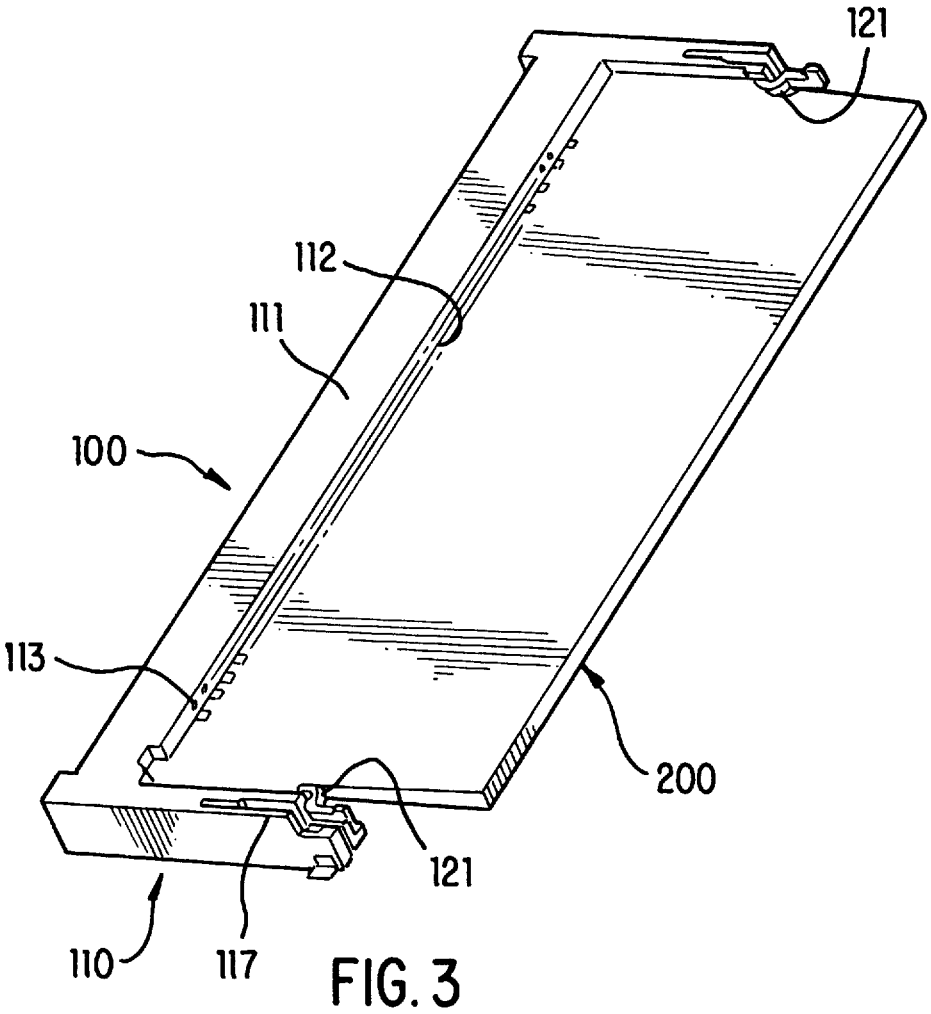
FIG. 3 is a perspective view of the edge card connector into which a card is fixed.

In FIGS. 1–3, a card 200 has two rows of contact pads 201 on upper and lower surfaces of an edge thereof. The two rows of contact pads 201 are offset to each other by a half pitch. When the card is inserted into a card edge connector, the contact pads 201 are brought into contact with contact elements of the connector.

A card edge connector 100 has an insulation housing 110 molded from an insulation material such as plastic. The insulation housing 110 has an elongated base 111 and a pair of side walls 118 extending laterally from the opposite ends of the base 111. The base 111 has a slot 112 for receiving an edge of the card 200 and a plurality of holes 113 and a plurality of grooves 114 for supporting a plurality of contact elements. The holes 113 and the grooves 114 are arranged in two rows on opposite sides of the slot 112 through the base 111. The holes 113 and the grooves 114 are spaced at regular intervals corresponding to the contact pads of the card 200. The holes on opposite sides are offset by a half pitch. The holes 113 on the upper side receive contact elements which contact with contact pads on the upper surface of the card while the grooves 114 on the lower side receive contact elements which contact with pads on the lower surface of the card.

The side walls 118 has abutment surfaces for abutment with the card 200. A pair of engaging sections 121 are provided on tops of the side walls 118 via arm sections 117, which are flexible outwardly so that the card 200 can pass the engaging sections 121. As best shown in FIG. 3, the arm sections 117 and the engaging sections 121 constitute a "latch structure" for holding the card 200 with the opposite sides in abutment with the abutment surfaces.

Figure 4B:
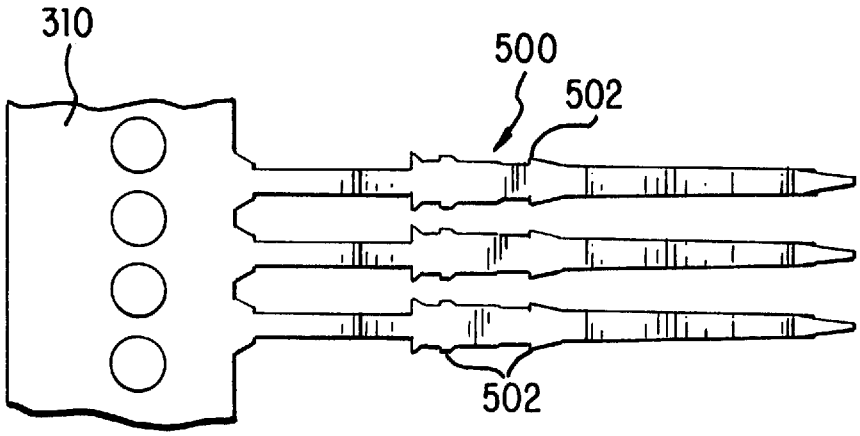
FIGS. 4(*a*), 4(*b*), and 4(*c*) are side, top, and front views of a first bent terminal according to an embodiment of the invention.
Figure 4A:
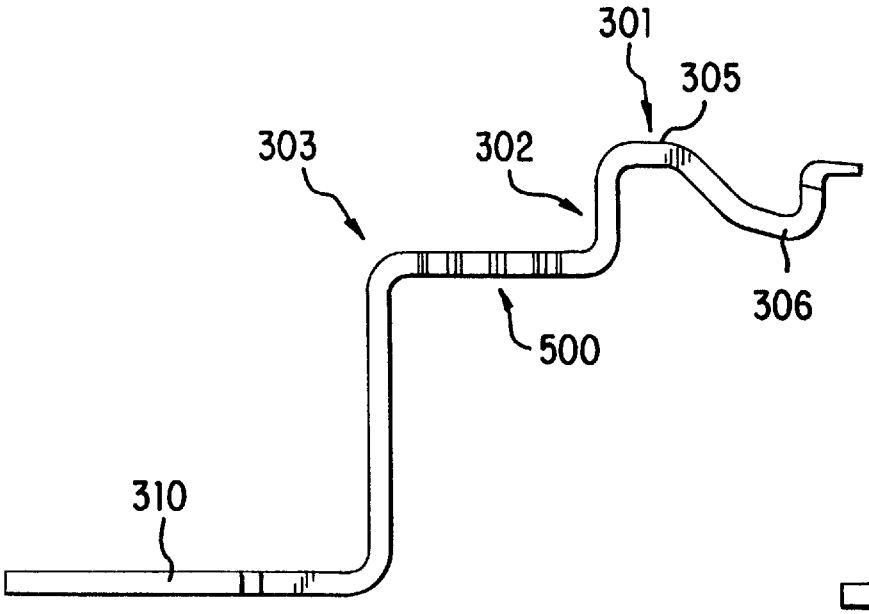
Figure 4C:
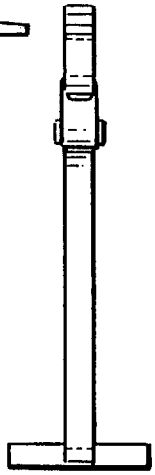
Figure 5B:
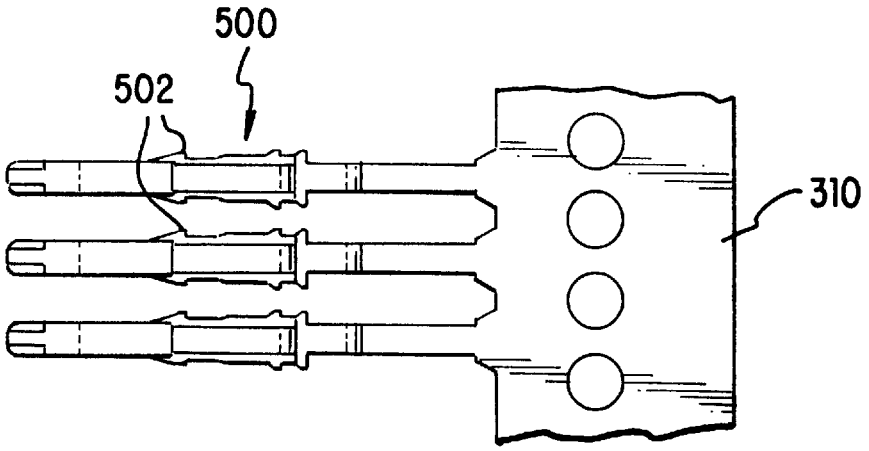
FIGS. 5(*a*), 5(*b*), and 5(*c*) are side, top, and front views of a second bent terminal according to an embodiment of the invention.
Figure 5A:
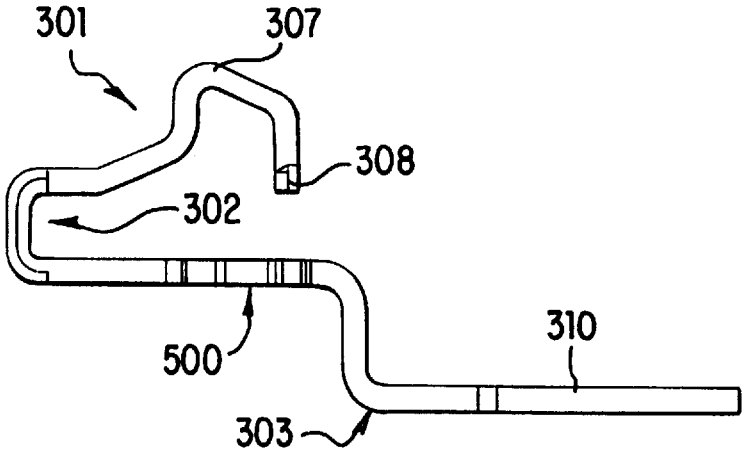
Figure 5C:
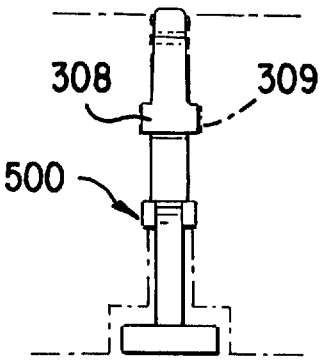

In FIGS. 4 and 5, contact elements have a movable arm 301, a fixing arm 303, and a central arm 302. After contact elements are fixed to the insulation housing, a linking section 310 is cut off.

In the first type of bent terminals in FIG. 4, the movable arm 301 and the fixing arm 303 extend from the central arm 302 in opposite directions, forming a cantilevered structure. The movable arm 301 has a large convex section 305 and a small concave section 306. The small concave section 306 contacts an upper side contact pad 201 of the card for electrically connecting the card to a circuit board. The fixing arm 303 has a connection section for connection to a conductor of the circuit board.

In FIG. 5, the second type of bent terminals has a movable arm 301 and a fixing arm 303 both extending from a central section 302 in the same direction, forming a substantially a C-shaped structure. This structure permits the entire length to be larger so that the stress applied to the second-type bent terminal is distributed to a larger area than that of the first-type bent terminal.

Figure 6:
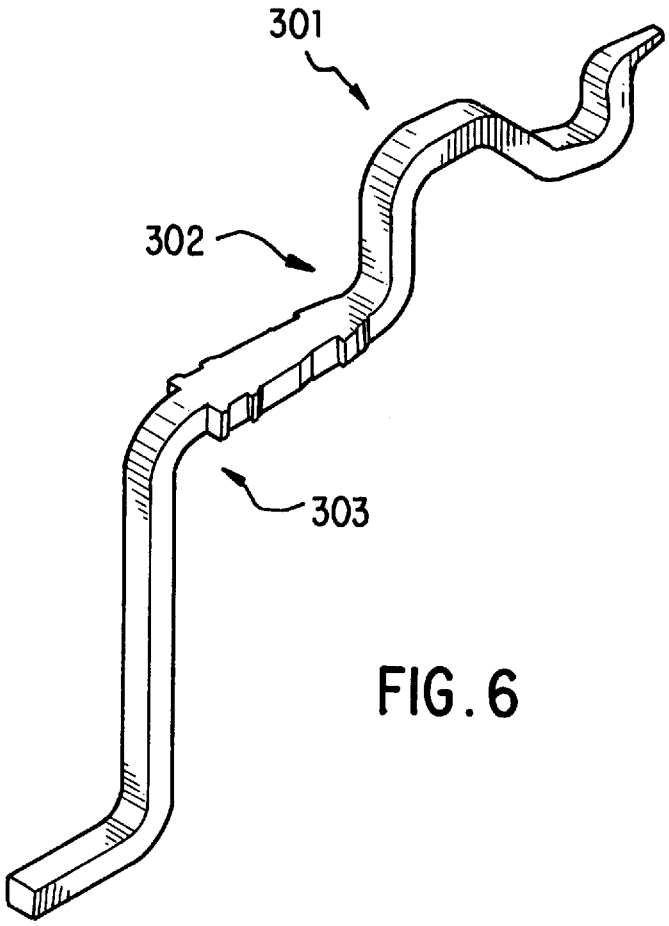
FIG. 6 is a perspective view of the first bent terminal according to the invention.
Figure 7:
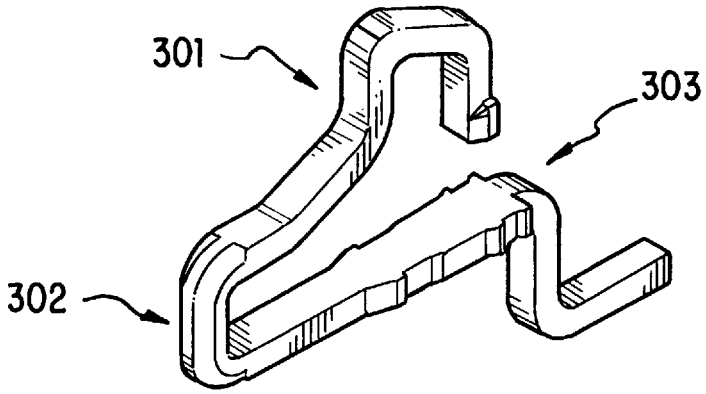
FIG. 7 is a perspective view of the second bent terminal according to the invention.

In FIGS. 6 and 7, the stress is distributed to a small area on the movable arm of the first-type bent terminal while the stress is distributed to a large area of the central section of the C-shaped second-type bent terminal. The C-shaped central section is made thinner in a part to provide a more resilient property. The C-shaped structure can provide a satisfactory resilient property in a small space.

Like the first-type bent terminal, the second-type bent terminal has a curved section 307 on the movable arm 301. Unlike the first-type bent terminal, the curved section 307 is convex only and contacts with a contact pad 201 on the lower surface of the card for electrically connecting the card to the circuit board. The card is inserted between the contact points of the first- and second-type bent terminals and held between them. Like the first-type bent terminal, the fixing arm 302 of the second-type of bent terminal has a fixing section for fixing the bent terminal to the insulation housing. Also, it has a connection section for connection to a conductor of the circuit board.

In FIG. 5(*c*), a stopper 308 is provided on the tip of the movable arm 301 of the second-type bent terminal. The stopper 308 engages a notch 309 in the groove 114 to pull down the movable arm 301 for forming a preload condition. The preload condition makes it easy to insert the card between the contact points of the first and second bent terminals. Also, it equalizes the amounts of projections of contact elements to assure contact between the card and the contact elements.

In FIGS. 4(*b*) and 5(*b*), before fitted in the holes 113 or grooves 114, the first and second-type bent terminals are joined together with linking sections 310 in sets. A large number of bent terminals are inserted into holes of the insulation housing, and the linking section 310 is cut off so that the work is made easy.

In FIGS. 4(*b*), 4(*c*), 5(*b*), and 5(*c*), wide sections 500 are provided on the fixing arms 303 of the first- and second-type bent terminals. The wide sections 500 make it possible to press fit the bent terminals into holes or grooves of the insulation housing. A plurality of barbs 502 are provided on the wide sections 500 to assure the press-fit connection. The wide sections 500 are tapered so as to facilitate insertion of the contact elements into the insulation housing.

Figure 8:
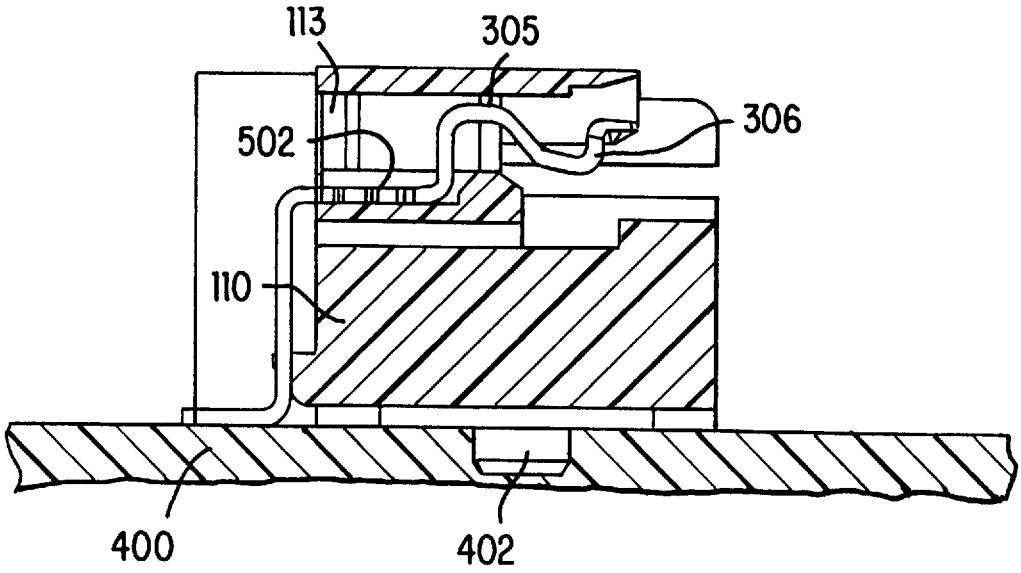
FIG. 8 is a sectional view taken along line 8—8 of FIG. 1.

In FIG. 8, the first-type bent terminal is inserted into a hole 113 (FIGS. 1–3) from the rear side of the connector such that the tip of the movable arm 301 is substantially flush with the entrance of the hole on the card insertion side. The wide sections 500 are press fitted into holes of the insulation housing, and the barbs 502 assure the fixation. After the linking section 310 is cut off, the ends of the fixing arms 303 are soldered to conductors of the circuit board.

Figure 9:
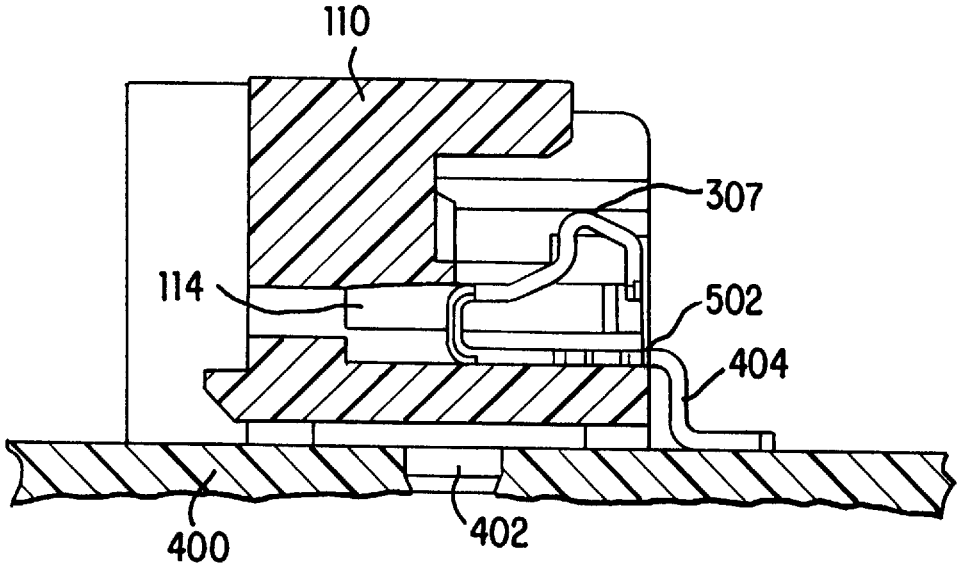
FIG. 9 is a sectional view taken along line 9—9 of FIG. 1.

In FIG. 9, the movable arm 301, the central arm 302, and the fixing arm 303 are inserted in the groove 114 (FIG. 1) of the insulation housing 110 from the card insertion side until the tip is fitted in the insulation housing 110. The wide section 500 is press fitted in the insulation housing 110, and the barbs 502 assures the fixation such that part of the fixing arm 303 from the curved portion 404 is placed in the insulation housing and the other part is placed outside the insulation housing. After the linking section 310 is cut off, the exposed portion is soldered to a conductor of the circuit board 400. When the second-type bent terminal is fixed in the insulation housing 110, the contact point of the movable arm 301 is closer to the entrance than that of the first-type bent terminal.

Figure 10:
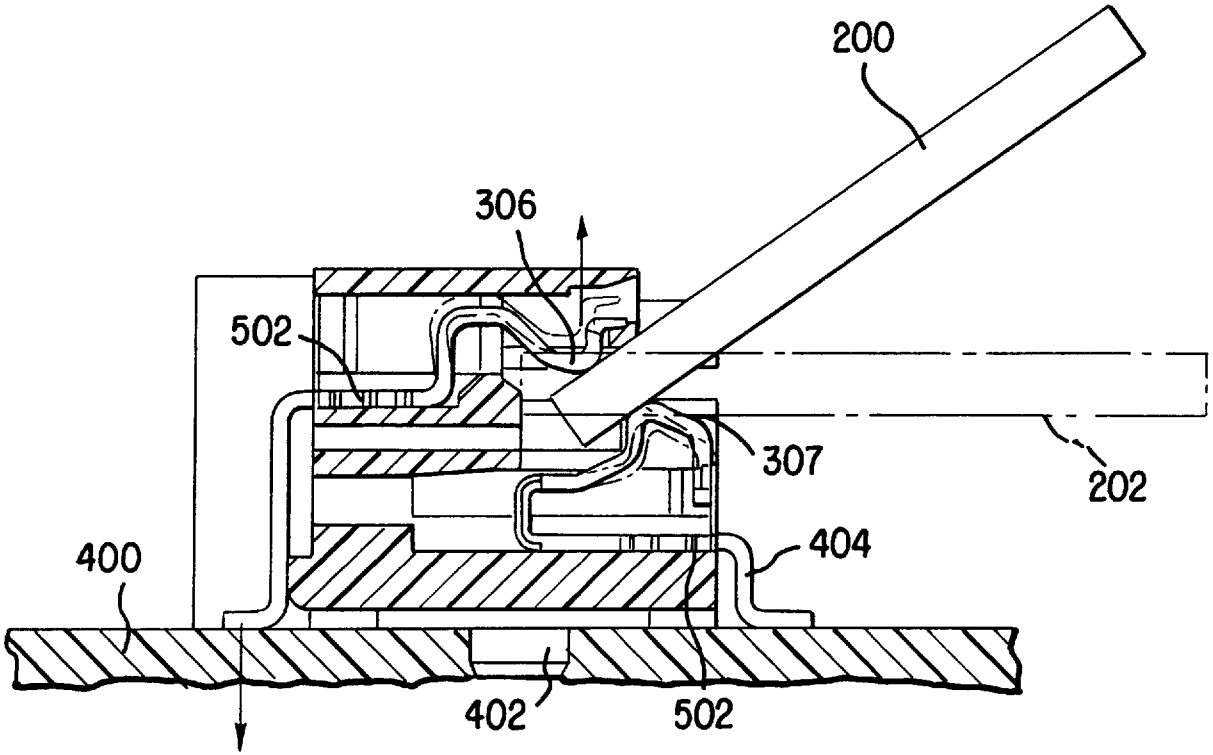
FIG. 10 is a sectional view of the card edge connector wherein both first and second bent terminals are shown at the same time.

In FIG. 10, when a card 200 is inserted between the first- and second-type bent terminals and rotated toward the circuit board, the upper and lower contact pads 201 of the card 200 are brought into contact with the curved portions 306 and 307 of the first- and second-type bent terminals. When the card 200 is rotated, the ends of the fixing arms 303 of the first-type bent terminals receive downward forces as shown by an arrow owing to the moment of rotation on the curved sections 306. The direction is the same as the direction in which the fixing arms 303 are mounted on the circuit board 400 so that separation of soldering does not occur.

Figure 11A:
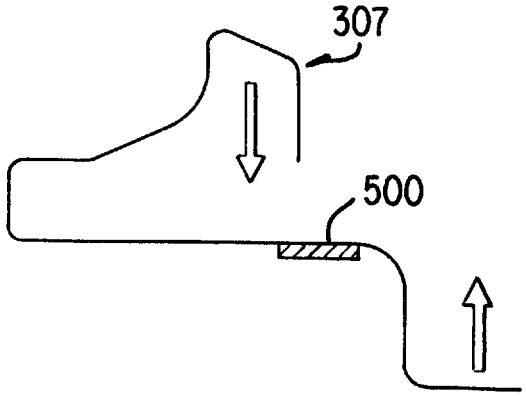
FIGS. 11(*a*), 11(*b*), and 11(*c*) are diagrams showing forces applied on fixing arms of the second bent terminals when a card is fixed.
Figure 11B:
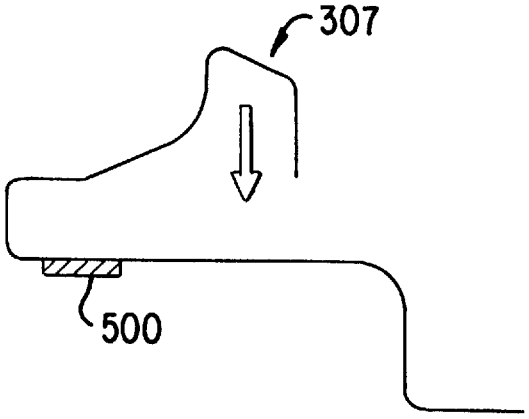
Figure 11C:
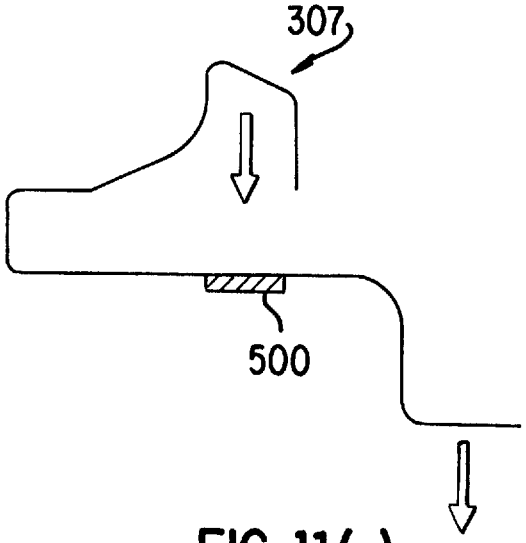

In FIG. 11(*a*), the contact point of the movable arm 307 is to the left from the fixing section 500 of the fixing arm or on the same side as the central arm with respect to the fixing section 500. In FIG. 11(*b*), the contact point is to the right from the fixing section 500 or on the side opposite to the central arm. In FIG. 11(*c*), the contact point is above the fixing section 500. That is, the distances between the central arm and the contact point are the same in the above three cases but the distances between the central arm and the fixing section are different. As shown by arrows, when the card is rotated, an upward force is applied to the end of the fixing arm in the case (a), but a downward force is applied to the fixing arm in the cases (b) and (c). In the case (a), the soldering can be separated whereas the forces in the cases (b) and (c) press the fixing arms down to the circuit board, thus preventing a soldering separation problem. According to the invention, the second-type bent terminals are made such that the contact point of a movable arm is positioned above the fixing section or to the right from the central arm.

Figure 12B:
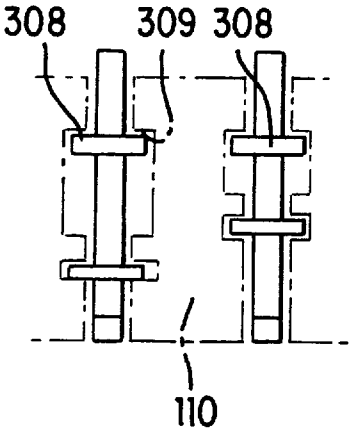
FIGS. 12(*a*) and 12(*b*) are sectional and front views of a card edge connector according to another embodiment of the invention.
Figure 12A:
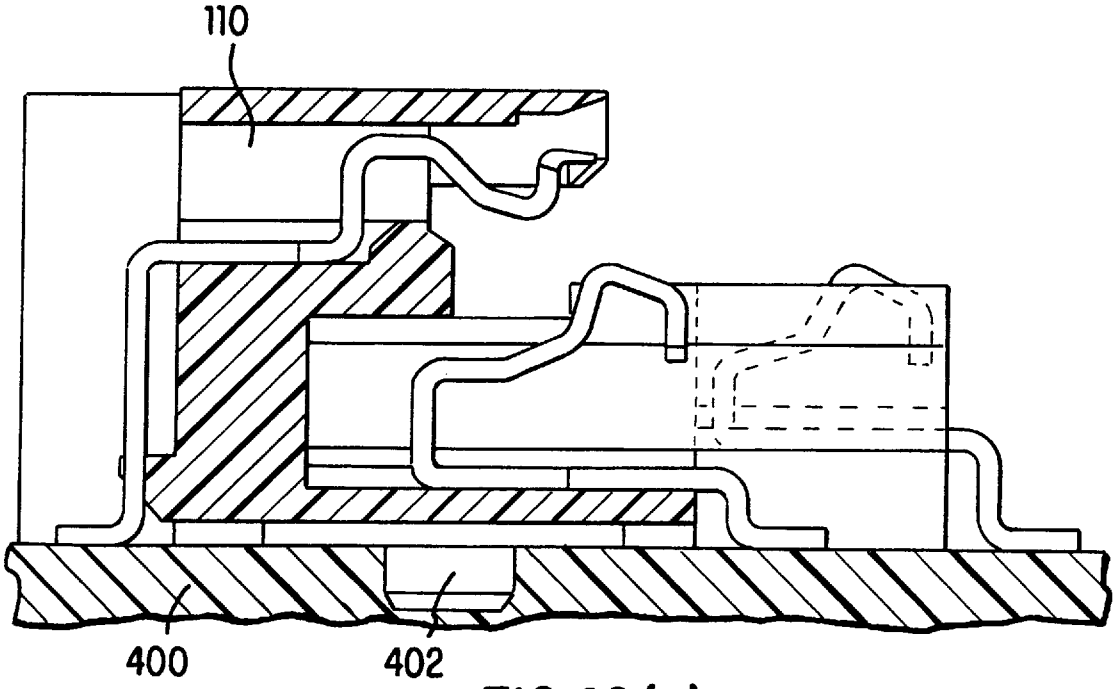

In FIG. 12, two rows of second-type bent terminals are arranged in the longitudinal direction of the insulation housing such that a row of every other second-type bent terminals is offset forwardly from the other row of second-type bent terminals. The first row of second-type bent terminals is arranged in the same planes as the first-type bent terminals while the other row of second-type bent terminals are offset by a half pitch in the longitudinal direction. Stoppers 308 provided on the tips of the second-type bent terminals engage notches 309 in the insulation housing 110 for reloading the bent terminals. By increasing the number of second-type bent terminals it is possible to increase the number of contact points between the card and contact elements or the conductors of the circuit board.

The bent terminals according to the invention provide satisfactory resilient properties with a spring constant lower than that of the conventional punched terminals. The contact elements are sufficiently long to distribute the stress applied to the contact elements, thereby preventing concentration of the stress. As a result, deformation of the contact elements and damage to the card edge connectors are prevented. The C-shaped structure of contact elements minimizes the space occupied by the contact elements and reducing the unit manufacturing costs.

The contact elements are joined together in sets before installed in the insulation housing so that it is easy to install a large number of contact elements in a insulation housing, resulting in the reduced manufacturing costs. The stoppers make it possible to preload the contact elements. Where the contact elements are surface-mounted, insertion and rotation of the card does not present a problem of separation of soldering between the contact elements and the circuit board.

What is claimed is:

1. A card edge connector to be surface-mounted on a circuit board having a plurality of conductors, comprising:

an insulation housing having a base section with a slot for receiving a card edge on which a plurality of contact pads are provided;

a plurality of bent-type contact elements arranged in said slot on at least one side on which said connector is to be mounted on said circuit board; said bent-type contact elements comprising:

a plurality of movable arms having contact points for contact with said contact pads of said card;

a plurality of fixing arms having connection sections for connection to said conductors of said circuit boards and fixing sections to be fixed to said insulation housing; and a plurality of central arms for connecting said movable arms and said fixing arms to form substantially C-shaped, flexible contact elements;

said connection sections of said fixing arms being at positions opposite to said central arms with respect to said fixing sections; and said contact points of said movable arms being at positions directly above said fixing sections or opposite to said central arms with respect to said fixing sections.

2. A card edge connector according to claim 1, wherein said fixing arms are provided with wide sections which are press-fitted into said insulation housing to fix said contact elements to said insulation housing.

3. A card edge connector according to claim 2, herein said wide sections are provided with barbs for assuring fixation of said contact elements to said insulation housing.

4. A card edge connector according to claim 1, wherein said insulation housing are provided with notches and said movable arms are provided on their tips with stoppers which engage said notches to bias said movable arms toward said circuit board, forming preload conditions.

5. A card edge connector according to claim 1, wherein said contact elements are arranged such that every other contact terminals are offset in said card insertion direction.

6. A card edge connector to be surface-mounted on a circuit board having a plurality of conductors, comprising:

an insulation housing having a base section with a slot for receiving a card edge on which a plurality of contact pads are provided;

a plurality of first bent-type contact elements arranged in said slot on a first side opposite to a second side on which said connector is to be mounted on said circuit board;

a plurality of second bent-type contact elements arranged in said slot on said second side; said second bent-type contact elements comprising:

a plurality of movable arms having contact points for contact with said contact pads of said card;

a plurality of fixing arms having connection sections for connection to said conductors of said circuit boards and fixing sections to be fixed to said insulation housing; and a plurality of central arms for connecting said movable arms and said fixing arms to form substantially C-shaped, flexible contact elements;

said connection sections of said fixing arms being at positions opposite to said central arms with respect to said fixing sections; and said contact points of said movable arms being at positions directly above said fixing sections or opposite to said central arms with respect to said fixing sections.

7. A card edge connector according to claim 6, wherein said first and second bent terminals are provided with wide sections at said fixing arms which are press-fitted into said insulation housing.

8. A card edge connector according to claim 7, wherein said wide sections are provided with barbs for assuring fixation of said contact elements to said insulation housing.

9. A card edge connector according to claim 6, wherein contact points of said movable arms of said first bent terminals are offset from contact points of said movable arms of said second bent terminals.

10. A card edge connector according to claim 6, wherein said insulation housing are provided with notches and said movable arms are provided on their tips with stoppers which engage said notches to bias said movable arms toward said circuit board, forming preload conditions.

11. A card edge connector according to claim 6, wherein said second bent terminals are arranged such that every other second bent terminals are offset in said card insertion direction.

12. A card edge connector according to claim 1, which further comprises a linking section for joining said bent terminals before they are put in said slot.

13. A card edge connector according to claim 6, which further comprises a linking section for joining said bent terminals before they are put in said slot.

* * * * *